US009453513B2

(12) United States Patent
Chen

(10) Patent No.: US 9,453,513 B2
(45) Date of Patent: Sep. 27, 2016

(54) NOISE ABSORPTION DEVICE FOR AIR BLOWER

(71) Applicant: Yu-Pei Chen, Zhubei (TW)

(72) Inventor: Yu-Pei Chen, Zhubei (TW)

( * ) Notice: Subject to any disclaimer, the term of this patent is extended or adjusted under 35 U.S.C. 154(b) by 430 days.

(21) Appl. No.: 14/224,142

(22) Filed: Mar. 25, 2014

(65) Prior Publication Data

US 2015/0275900 A1 Oct. 1, 2015

(51) Int. Cl.
*F04D 29/66* (2006.01)
*F04D 17/10* (2006.01)
*F04D 17/16* (2006.01)

(52) U.S. Cl.
CPC ..... *F04D 17/10* (2013.01); *F04D 17/16* (2013.01); *F04D 29/664* (2013.01)

(58) Field of Classification Search
CPC ..... F04D 17/10; F04D 17/16; F04D 17/165; F04D 19/002; F04D 29/66; F04D 29/663; F04D 29/664; F04D 29/665
See application file for complete search history.

(56) References Cited

U.S. PATENT DOCUMENTS 5,199,846 A * 4/1993 Fukasaku ..... F04D 29/664 181/224
5,336,046 A * 8/1994 Hashimoto ..... B60H 1/00471 415/119
6,575,695 B1 * 6/2003 Miyamoto ..... A01G 1/125 15/326
2002/0060107 A1 * 5/2002 Kamoshita ..... F04D 29/664 181/214

* cited by examiner

*Primary Examiner* — Audrey K Bradley

(57) ABSTRACT

An air blower is provided with an upper resonant chamber including an upper cover having an opening, an upper casing having an inlet engaging the opening, the upper casing secured to the upper cover to form a first chamber, first apertures through portions of the upper casing other than the inlet and communicating with the first chamber, and a first noise absorption material in the first chamber; a lower resonant chamber including a lower cover, a lower casing secured to the lower cover to form a second chamber, second apertures through the lower casing and communicating with the second chamber, and a second noise absorption material in the second chamber. The upper casing is on the lower casing to form a flow path. An impeller is in the flow path. In response to resonance, noise can be absorbed by the first and second absorption materials and converted into heat.

2 Claims, 6 Drawing Sheets

NOISE ABSORPTION DEVICE FOR AIR BLOWER

BACKGROUND OF THE INVENTION

1. Field of the Invention

The invention relates to air blowers and more particularly to an air blower having a noise absorption device for converting absorbed acoustic energy into heat.

2. Description of Related Art

Typically, a centrifugal blower can be either a spiral air blower having an inlet and an outlet at angle of about 90-degree with respect to the inlet, or a linear air blower having both inlet and outlet arranged in a straight line. Both types of centrifugal blower have an impeller for generating high air pressure and are applicable to air blowers having a narrow outlet or complicated pipes. They are also widely used in heat sinks of electronic devices, automotive air conditioners, or building pipelines. However, the high air pressure may cause turbulence and spiral airflow, resulting in making noise having different frequencies. To the worse, maximum noise can be generated when frequency of vibration obtained by multiplying the number of blades by revolutions per second.

Thus, the need for improvement still exists.

SUMMARY OF THE INVENTION

It is therefore one object of the invention to provide an air blower comprising an upper resonant chamber including an upper cover having an opening, an upper casing having an inlet having a top engaging the opening, the upper casing secured to the upper cover to form a first chamber, a plurality of first apertures through portions of the upper casing other than the inlet and communicating with the first chamber, and a first noise absorption material disposed in the first chamber; a lower resonant chamber including a lower cover, a lower casing secured to the lower cover to form a second chamber, a plurality of second apertures through a bottom of the lower casing and communicating with the second chamber, and a second noise absorption material disposed in the second chamber wherein the upper casing is disposed on the lower casing to form a spiral flow path; an impeller disposed in the spiral flow path; and an outlet disposed at an end of the spiral flow path; wherein in response to activating the air blower, noise generated by the impeller enters the upper resonant chamber via the first apertures and the lower resonant chamber via the second apertures respectively, air in the upper resonant chamber vibrates to friction the first noise absorption material and the first apertures, and air in the lower resonant chamber vibrates to friction the second noise absorption material and the second apertures when frequencies of vibration of both the upper and lower resonant chambers match frequency of vibration of the impeller so that acoustic energy is absorbed by the first and second absorption materials and converted into heat.

It is another object of the invention to provide an air blower comprising an upper resonant chamber including an upper cover having a first opening, an upper casing having an inlet engaging the first opening, the upper casing secured to the upper cover to form a first chamber, a plurality of first apertures through portions of the upper casing other than the inlet and communicating with the first chamber, and a first noise absorption material disposed in the first chamber; a lower resonant chamber including a lower cover having a second opening, a lower casing having an outlet, the lower casing secured to the lower cover to form a second chamber and the second opening put on the lower casing, a plurality of second apertures through a bottom of the lower casing and communicating with the second chamber, and a second noise absorption material disposed in the second chamber wherein the upper casing is disposed on the lower casing to form a circular flow path; an impeller disposed in the circular flow path; and wherein in response to activating the air blower, noise generated by the impeller enters the upper resonant chamber via the first apertures and the lower resonant chamber via the second apertures respectively, air in the upper resonant chamber vibrates to friction the first noise absorption material and the first apertures, and air in the lower resonant chamber vibrates to friction the second noise absorption material and the second apertures when frequencies of vibration of both the upper and lower resonant chambers match frequency of vibration of the impeller so that acoustic energy is absorbed by the first and second absorption materials and converted into heat.

The above and other objects, features and advantages of the invention will become apparent from the following detailed description taken with the accompanying drawings.

DETAILED DESCRIPTION OF THE INVENTION

Figure 1:
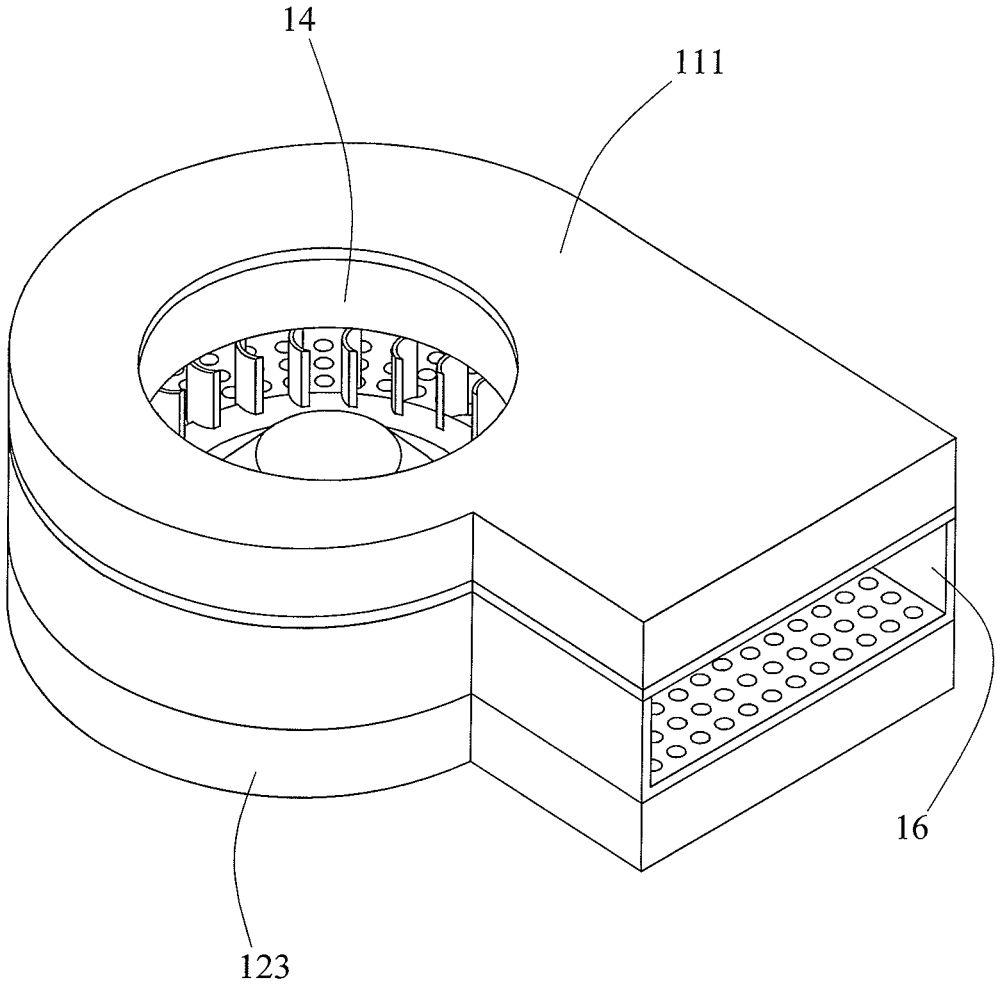
FIG. 1 is a perspective view of an air blower according to a first preferred embodiment of the invention.
Figure 2:
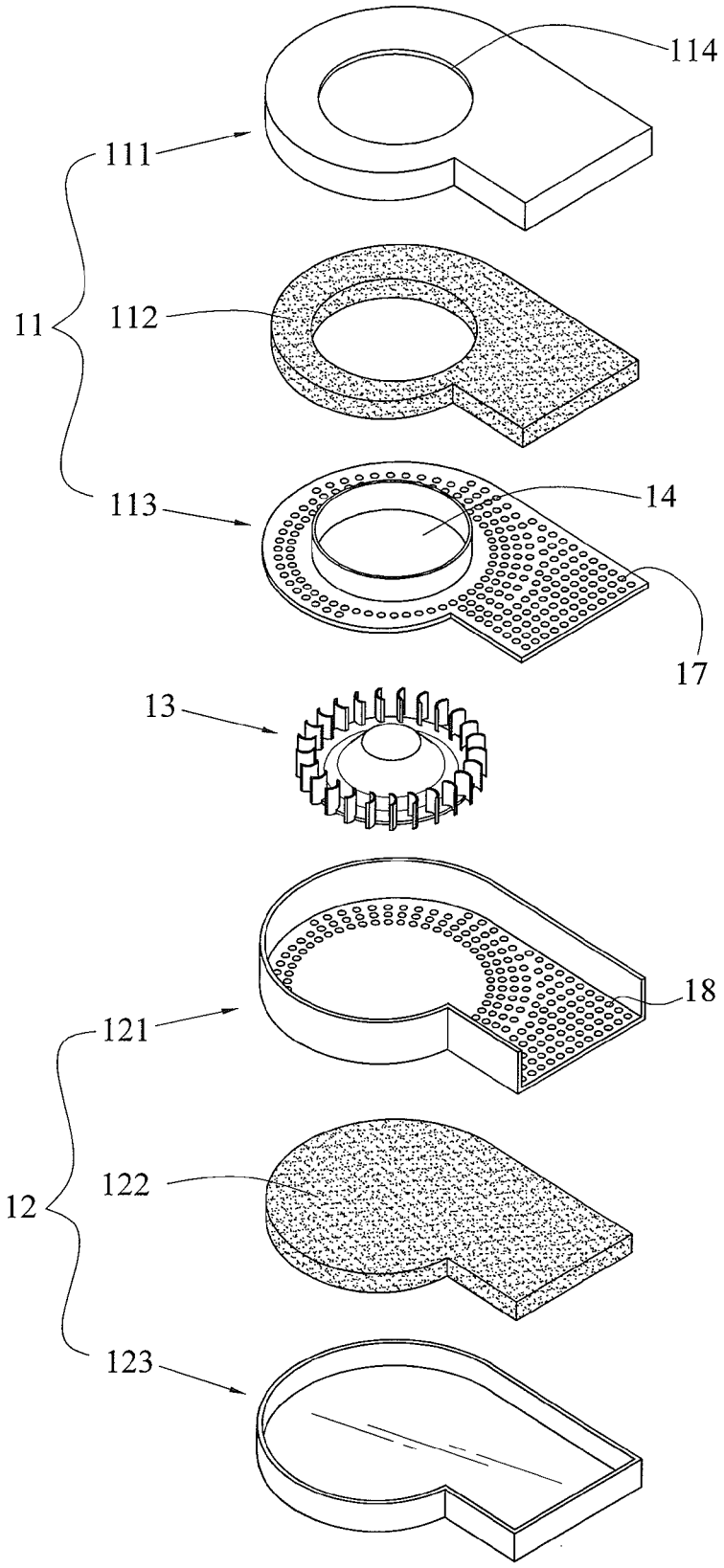
FIG. 2 is an exploded view of the air blower shown in FIG. 1.
Figure 3:
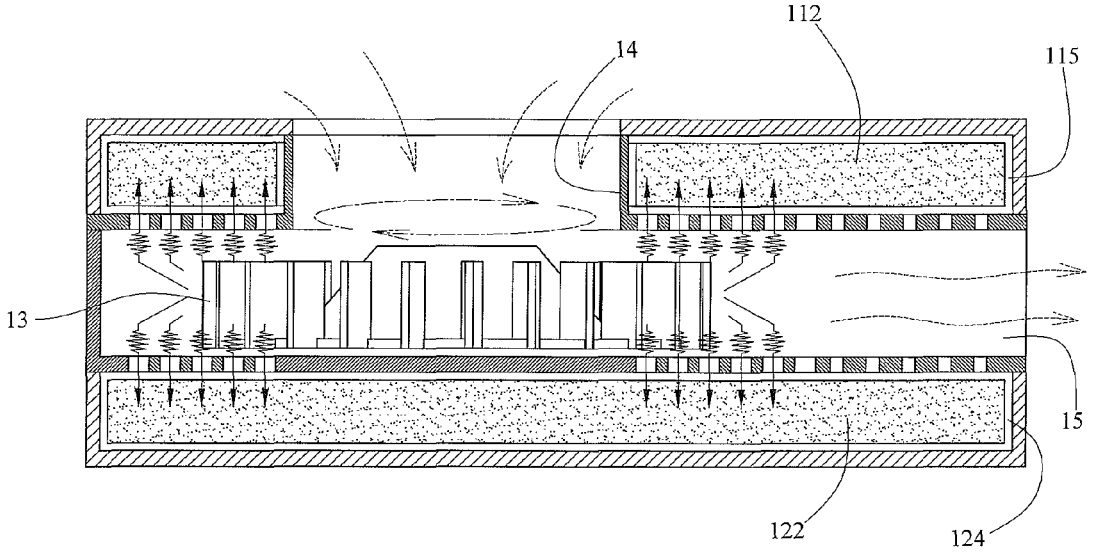
FIG. 3 is a longitudinal sectional view of the air blower of FIG. 1 with noise propagation directions shown in solid line arrows and air flow shown in dashed line arrows.

Referring to FIGS. 1 to 3, an air blower (e.g., centrifugal blower) in accordance with a first preferred embodiment of the invention comprises the following components as discussed in detail below.

An upper resonant chamber 11 includes an upper cover 111 and an upper casing 113. An opening 114 is formed through the upper cover 111. A flange inlet 14 is formed through the upper casing 113. The upper cover 111 is secured to the upper casing 113 to form a first chamber 115. A top edge of the inlet 14 is engaged with the opening 114. A plurality of first apertures 17 are formed through portions of the upper casing 113 other than the inlet 14 and communicate with the first chamber 115. A first noise absorption material 112 occupies all space of the first chamber 115.

A lower resonant chamber 12 includes a lower cover 123 and a lower casing 121 secured to the lower cover 123 to form a second chamber 124. A plurality of second apertures 18 are formed through a bottom of the lower casing 121 and communicate with the second chamber 124. A second noise absorption material 122 occupies all space of the second chamber 124. The upper casing 113 is disposed on the lower casing 121 so as to form a spiral flow path 15. A motor (not shown) and an impeller 13 having a plurality of small blades on the circumference are disposed in the spiral flow path 15. An outlet 16 is formed at an end of the spiral flow path 15.

After activating the air blower, noise generated by the impeller 13 enters the upper resonant chamber 11 via the first apertures 17 and the lower resonant chamber 12 via the second apertures 18 respectively. Air in the upper resonant chamber 11 will vibrate to friction the first noise absorption material 112 and the first apertures 17, and air in the lower resonant chamber 12 will vibrate to friction the second noise absorption material 122 and the second apertures 18 when the frequencies of vibration of both the upper and lower resonant chambers 11, 12 match the frequency of vibration of the impeller 13 (i.e., resonance occurred). As a result, the acoustic energy is absorbed by the first and second absorption materials and converted into heat.

Resonant frequency of the upper resonant chamber 11 can be adjusted by increasing or decreasing diameters of the first apertures 17 and increasing or decreasing wall thickness of the first chamber 115. The smaller of the diameters of the first apertures 17, the greater of distance between any two adjacent first apertures 17, and the thicker of the wall of the first chamber 115 the lower of the resonant frequency of the upper resonant chamber 11 will be. Likewise, resonant frequency of the lower resonant chamber 12 can be adjusted by increasing or decreasing diameters of the second apertures 18 and increasing or decreasing wall thickness of the second chamber 124. The smaller of the diameters of the second apertures 18, the greater of distance between any two adjacent second apertures 18, and the thicker of the wall of the second chamber 124 the lower of the resonant frequency of the lower resonant chamber 12 will be.

Figure 4:
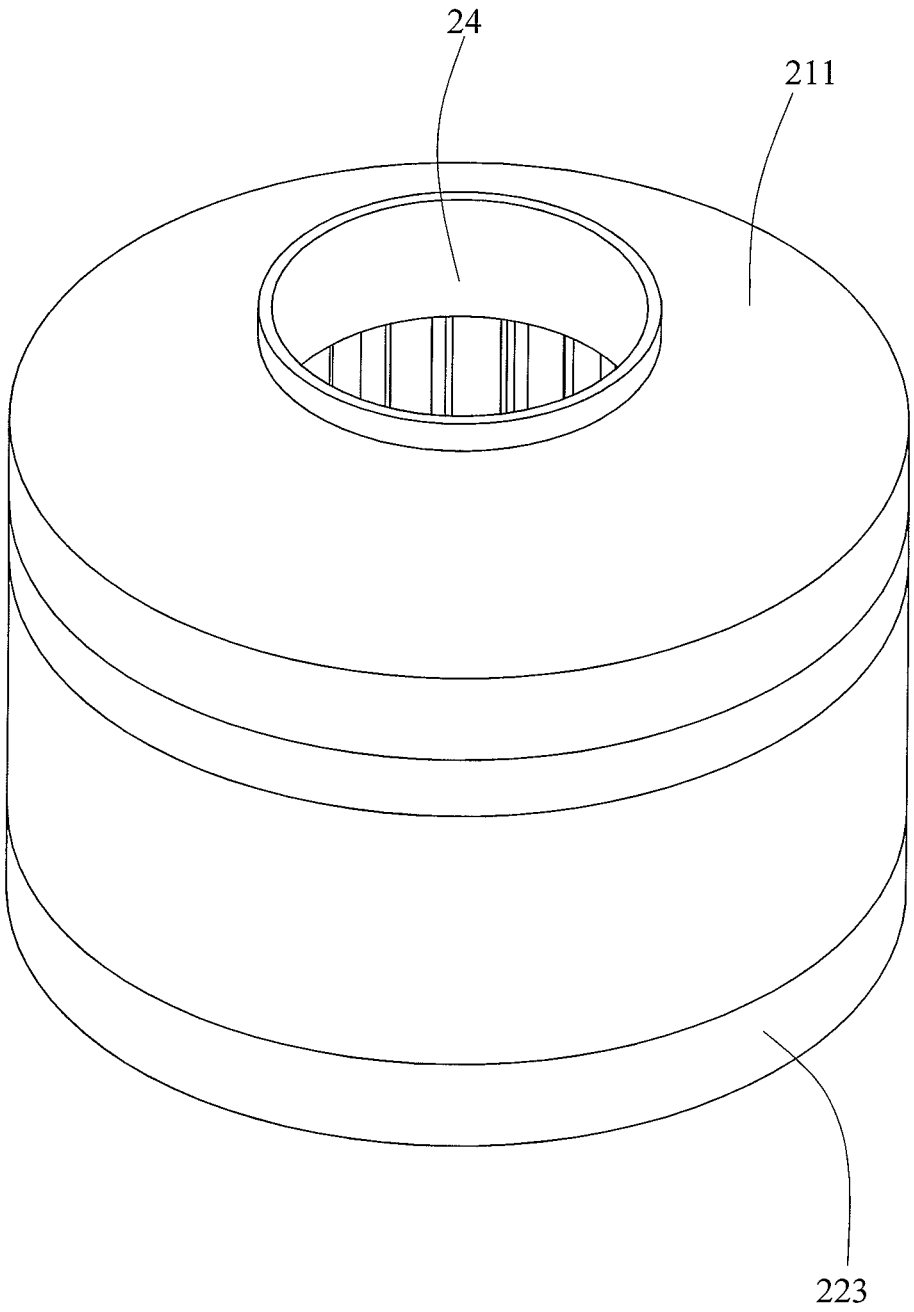
FIG. 4 is a perspective view of an air blower according to a second preferred embodiment of the invention.
Figure 5:
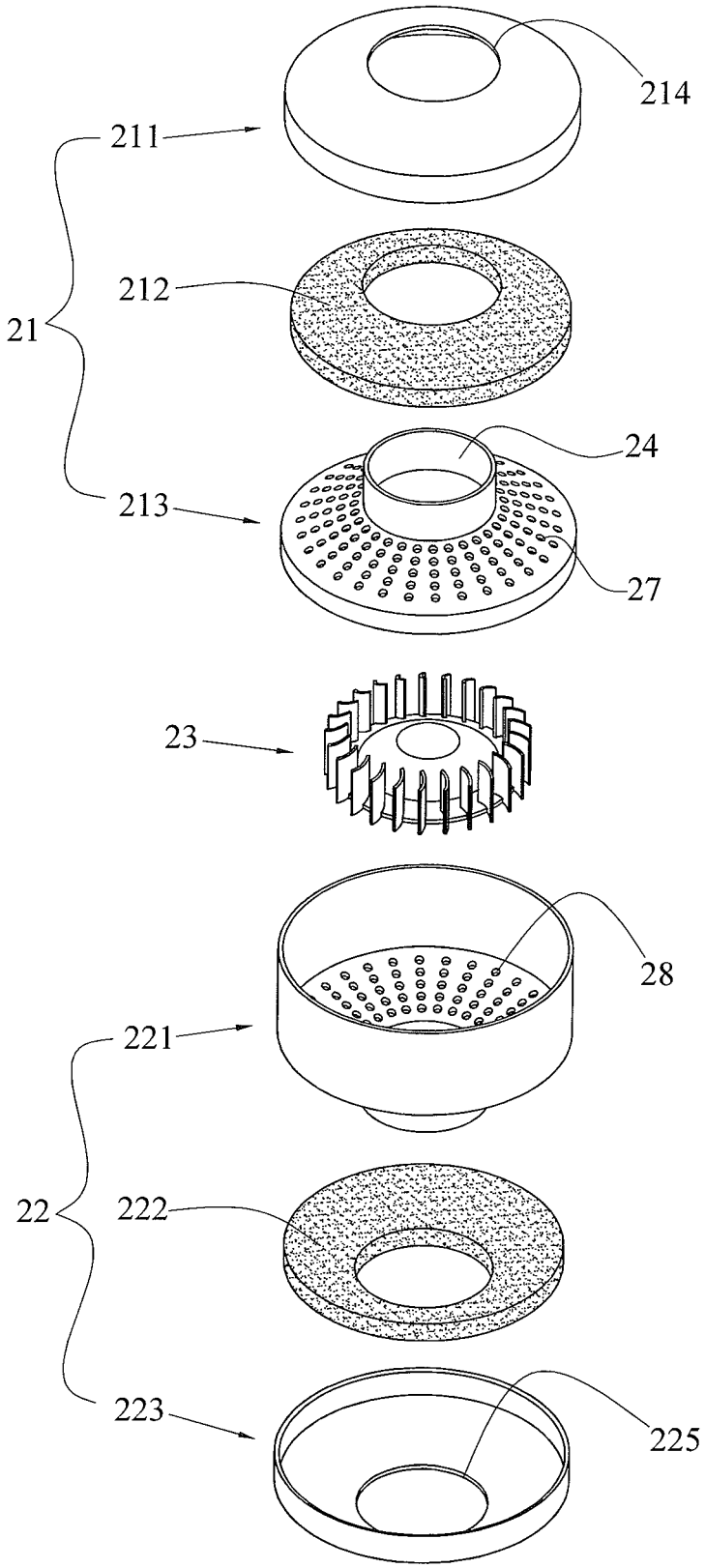
FIG. 5 is an exploded view of the air blower shown in FIG. 4.
Figure 6:
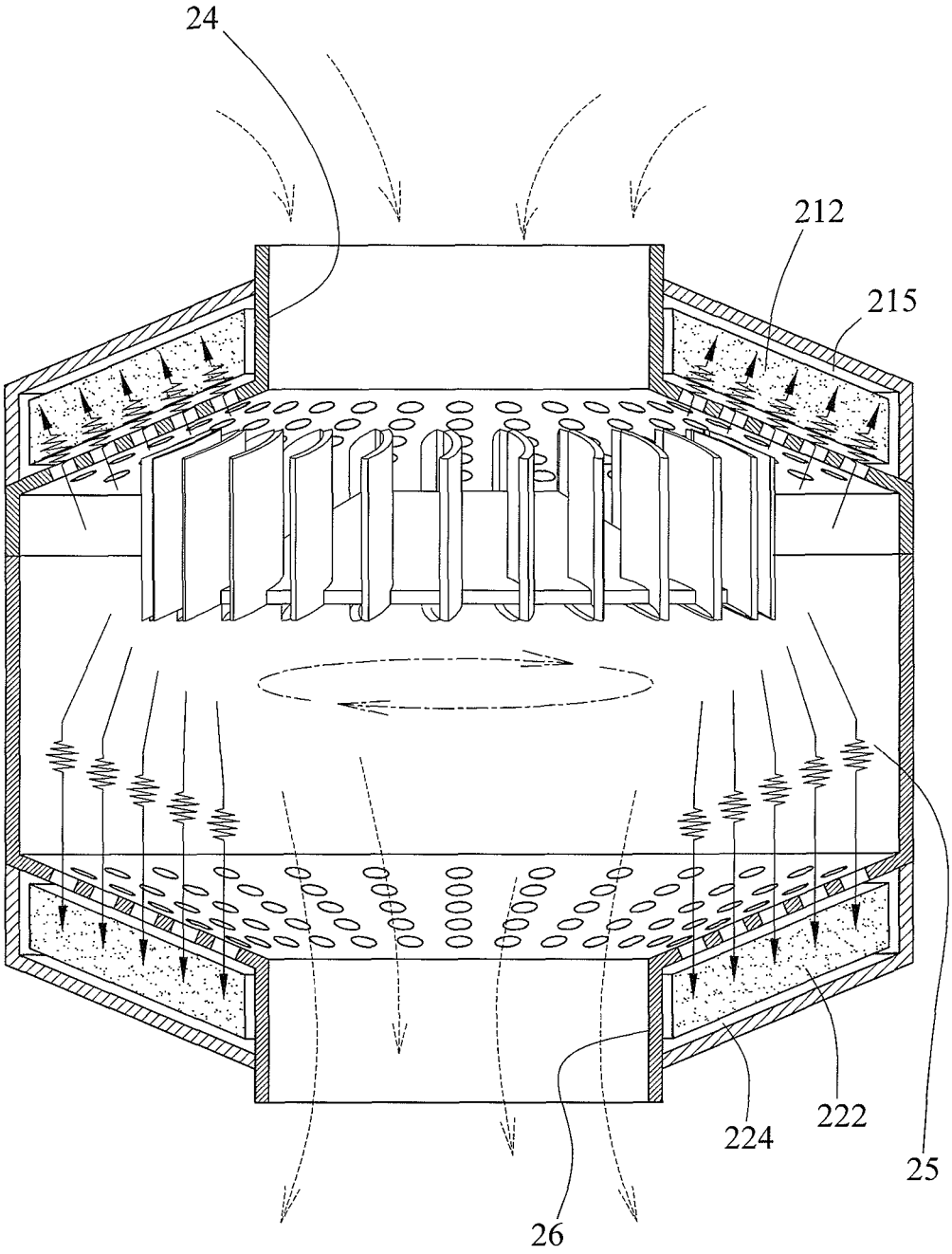
FIG. 6 is a longitudinal sectional view of the air blower of FIG. 4 with noise propagation directions shown in solid line arrows and air flow shown in dashed line arrows.

Referring to FIGS. 4 to 6, an air blower (e.g., linear air blower) in accordance with a second preferred embodiment of the invention is shown. Characteristics of the second preferred embodiment are substantially the same as that of the first preferred embodiment except the following:

Inlet and outlet are aligned. An upper resonant chamber 21 includes an upper cover 211 and an upper casing 213. An opening 214 is formed through the upper cover 211. A flange inlet 24 is formed through the upper casing 213. The upper cover 211 is secured to the upper casing 213 to form a first chamber 215. Atop edge of the inlet 24 is engaged with the opening 214. A plurality of first apertures 27 are formed through portions of the upper casing 213 other than the inlet 24 and communicate with the first chamber 215. A first noise absorption material 212 occupies all space of the first chamber 215.

A lower resonant chamber 22 includes a lower cover 223 having a bottom opening 225, and a lower casing 221 secured to the lower cover 223 to form a second chamber 224. The opening 225 is put on the lower casing 221. An outlet 26 is formed at an end of the lower casing 221. A plurality of second apertures 28 are formed through a bottom of the lower casing 221 and communicate with the second chamber 224. A second noise absorption material 222 occupies all space of the second chamber 224. The upper casing 213 is disposed on the lower casing 221 so as to form a circular flow path 25. A motor (not shown) and an impeller 23 having a plurality of small blades on the circumference are disposed in the circular flow path 25.

After activating the air blower, noise generated by the impeller 23 enters the upper resonant chamber 21 via the first apertures 27 and the lower resonant chamber 22 via the second apertures 28 respectively. Air in the upper resonant chamber 21 will vibrate to friction the first noise absorption material 212 and the first apertures 27, and air in the lower resonant chamber 22 will vibrate to friction the second noise absorption material 222 and the second apertures 28 when the frequencies of vibration of both the upper and lower resonant chambers 21, 22 match the frequency of vibration of the impeller 23 (i.e., resonance occurred). As a result, the acoustic energy is absorbed by the first and second absorption materials and converted into heat.

Resonant frequency of the upper resonant chamber 21 can be adjusted by increasing or decreasing diameters of the first apertures 27 and increasing or decreasing wall thickness of the first chamber 215. The smaller of the diameters of the first apertures 27, the greater of distance between any two adjacent first apertures 27, and the thicker of the wall of the first chamber 215 the lower of the resonant frequency of the upper resonant chamber 21 will be. Likewise, resonant frequency of the lower resonant chamber 22 can be adjusted by increasing or decreasing diameters of the second apertures 28 and increasing or decreasing wall thickness of the second chamber 224. The smaller of the diameters of the second apertures 28, the greater of distance between any two adjacent second apertures 28, and the thicker of the wall of the second chamber 224 the lower of the resonant frequency of the lower resonant chamber 22 will be.

While the invention has been described in terms of preferred embodiments, those skilled in the art will recognize that the invention can be practiced with modifications within the spirit and scope of the appended claims.

What is claimed is:

1. An air blower comprising:

an upper resonant chamber including an upper cover having an opening, an upper casing having an inlet having a top engaging the opening, the upper casing secured to the upper cover to form a first chamber, a plurality of first apertures through portions of the upper casing other than the inlet and communicating with the first chamber, and a first noise absorption material disposed in the first chamber;

a lower resonant chamber including a lower cover, a lower casing secured to the lower cover to form a second chamber, a plurality of second apertures through a bottom of the lower casing and communicating with the second chamber, and a second noise absorption material disposed in the second chamber wherein the upper casing is disposed on the lower casing to form a spiral flow path;

an impeller disposed in the spiral flow path; and an outlet disposed at an end of the spiral flow path;

wherein in response to activating the air blower, noise generated by the impeller enters the upper resonant chamber via the first apertures and the lower resonant chamber via the second apertures respectively, air in the upper resonant chamber vibrates to friction the first noise absorption material and the first apertures, and air in the lower resonant chamber vibrates to friction the second noise absorption material and the second apertures when frequencies of vibration of both the upper and lower resonant chambers match frequency of vibration of the impeller so that acoustic energy is absorbed by the first and second absorption materials and converted into heat.

2. An air blower comprising:

an upper resonant chamber including an upper cover having a first opening, an upper casing having an inlet engaging the first opening, the upper casing secured to the upper cover to form a first chamber, a plurality of first apertures through portions of the upper casing other than the inlet and communicating with the first chamber, and a first noise absorption material disposed in the first chamber;

a lower resonant chamber including a lower cover having a second opening, a lower casing having an outlet, the lower casing secured to the lower cover to form a second chamber and the second opening put on the lower casing, a plurality of second apertures through a bottom of the lower casing and communicating with the second chamber, and a second noise absorption material disposed in the second chamber wherein the upper casing is disposed on the lower casing to form a circular flow path; and an impeller disposed in the circular flow path;

wherein in response to activating the air blower, noise generated by the impeller enters the upper resonant chamber via the first apertures and the lower resonant chamber via the second apertures respectively, air in the upper resonant chamber vibrates to friction the first noise absorption material and the first apertures, and air in the lower resonant chamber vibrates to friction the second noise absorption material and the second apertures when frequencies of vibration of both the upper and lower resonant chambers match frequency of vibration of the impeller so that acoustic energy is absorbed by the first and second absorption materials and converted into heat.

* * * * *